US005220120A

United States Patent [19]

Mukaino

[11] Patent Number: 5,220,120

[45] Date of Patent: Jun. 15, 1993

[54] AUTOMATIC PLAY DEVICE HAVING CONTROLLABLE TEMPO SETTINGS

[75] Inventor: Hirofumi Mukaino, Hamamatsu, Japan

[73] Assignee: Yamaha Corporation, Hamamatsu, Japan

[21] Appl. No.: 677,170

[22] Filed: Mar. 29, 1991

[30] Foreign Application Priority Data

Mar. 30, 1990 [JP] Japan ..... 2-83709
Mar. 30, 1990 [JP] Japan ..... 2-86851

[51] Int. Cl.[5] ..... G10H 7/00

[52] U.S. Cl. ..... 84/636; 84/652; 84/668

[58] Field of Search ..... 84/634-636, 84/649-652, 666-668

[56] References Cited

U.S. PATENT DOCUMENTS 4,033,220 7/1977 Shibahara ..... 84/1.03
4,361,066 11/1982 Jones ..... 84/636
4,432,266 2/1984 Nakada ..... 84/652
4,655,113 4/1987 Bunger et al. ..... 84/636
4,694,724 9/1987 Kikumoto et al. ..... 84/652
5,164,529 11/1992 Saito ..... 84/612

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An automatic play device generates a tempo signal at a frequency corresponding to a tempo setting value. When a tempo setting value is changed, the device changes the frequency of the tempo signal gradually from one frequency corresponding to the tempo setting value prior to the change to another frequency corresponding to a target tempo setting value posterior to the change, so that a smooth tempo change can be realized. It is also possible to automatically adjust the tempo in correspondence to a time interval between on-events of a tap switch, in which case the automatic play is controlled so as to stop when on-state of the tap switch continues for more than a predetermined time.

17 Claims, 10 Drawing Sheets

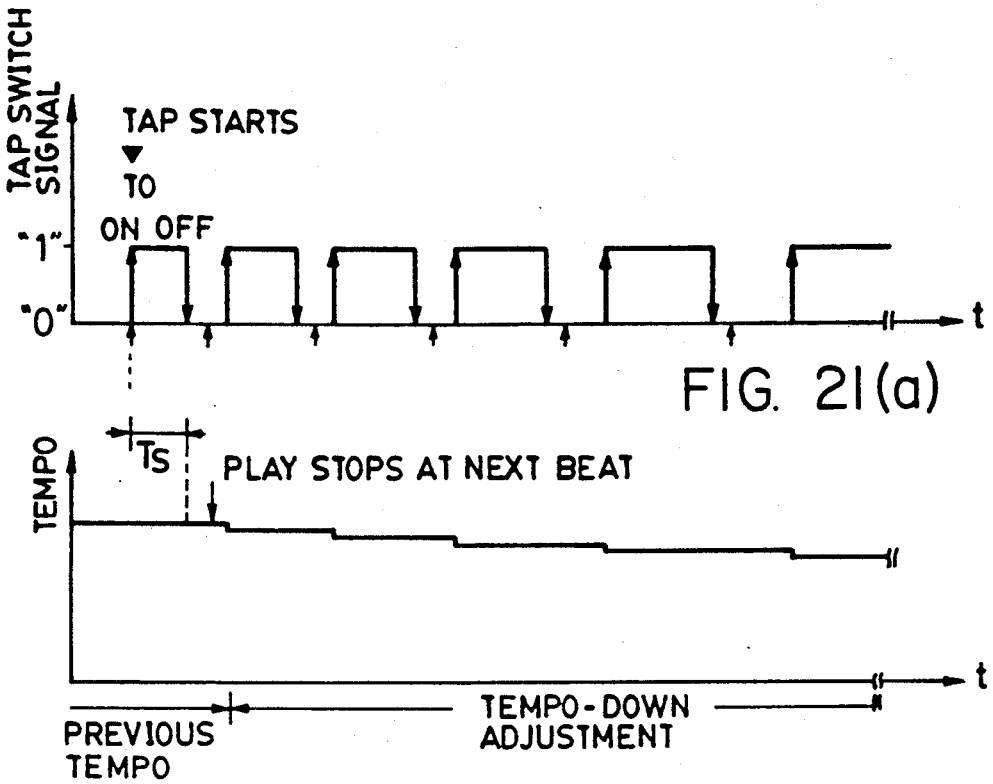
FIG. 21(a)
FIG. 21(b)
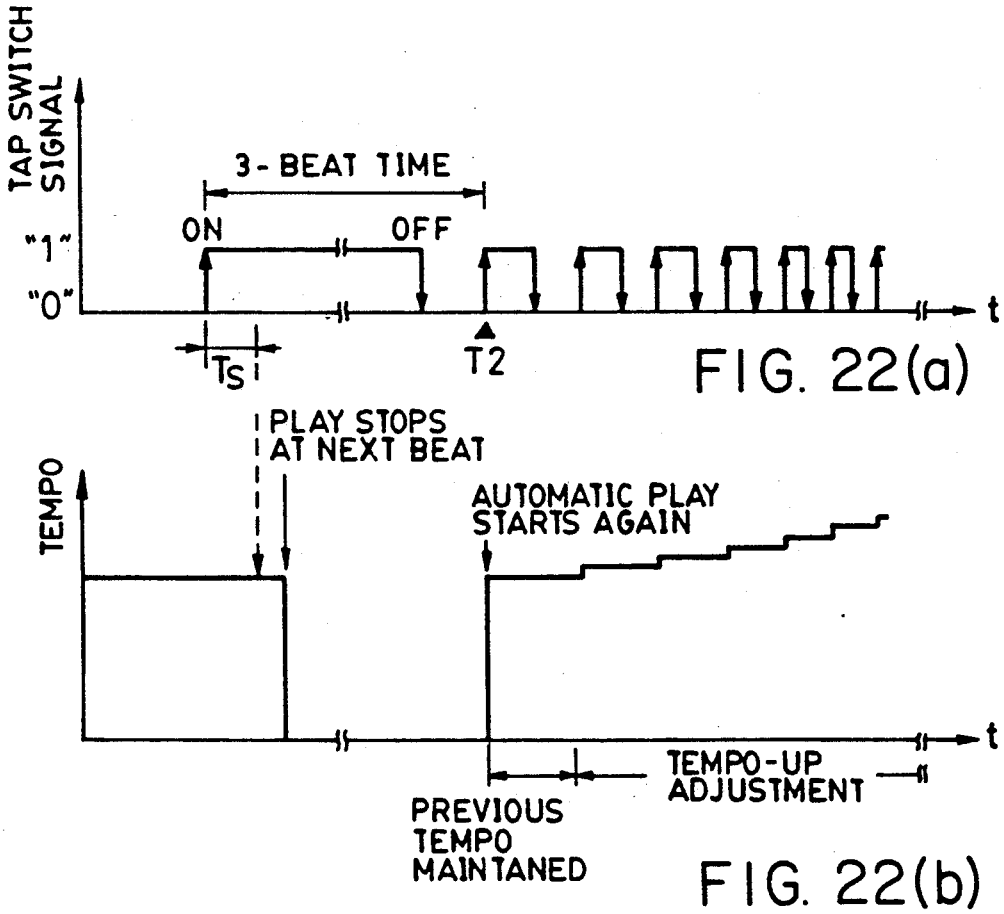
FIG. 22(a)
FIG. 22(b)

AUTOMATIC PLAY DEVICE HAVING CONTROLLABLE TEMPO SETTINGS

BACKGROUND OF THE INVENTION

One embodiment of the present invention relates generally to an automatic play device such as a sequencer of a musical instrument, automatic accompaniment device, automatic rhythm playing device or the like, and more particularly to an automatic play device which can effectively realize a smooth tempo change from one tempo to another corresponding to a tempo change operation.

In Japanese Patent Laid-open Publication Nos. 58-211191 or 63-193192, there is disclosed an example of a sequencer-type automatic play device of which stores play data inputted from a keyboard of a musical instrument, a computer or the like and reproduces a tone based on the stored play data. In such an automatic play device, the play data is read out from a memory in response to a tempo clock, and then a tone signal is generated based on the read-out play data. The tempo clock frequency can be changeably controlled in correspondence to a tempo setting value and thus the reproduction play tempo can be freely changed to desired one. The tempo setting value can be continuously changed by operating a tempo setting knob, or it can be changed in response to a suitable switch operation. However, the prior art automatic play devices are disadvantageous in that when tempo change operation is made during the play by means of the tempo setting operator such as the knob or switch, the tempo is caused to change immediately and hence abruptly to a new tempo after the operation, which inevitably gives an impression of awkward intermission. Further, in such device that can continuously change the play tempo by the operation of the tempo setting knob, it will become quite an obstacle to turn the knob slowly during a manual play in an order to change the tempo smoothly.

Also, the aforesaid sequencers can be connected via MIDI terminals with a MIDI musical instrument, and the automatic play tempo can be adjusted by changing a tempo clock frequency of play data supplied from the sequencer to the MIDI musical instrument connected in master-slave fashion therewith. In a specific type of the sequencers, the tempo can be changed in correspondence to the player's own beating time action; for example, in the case where a pedal switch for adjusting a tempo is provided in the sequencer, the player can control the automatic play tempo by stepping on the pedal switch at a desired tempo (hereinafter, this step-on operation will be called a tap). In this case, the sequencer detects when the pedal switch is stepped on (switched on), and at each time of detection, it changes a timing clock frequency in accordance with the time interval between the times of the current and last step-on operations of the pedal switch. However, in such sequencer, since the play tempo is determined in correspondence to the tap interval, the music play is undesirably caused to stop if the player stops tapping. Thus, the sequencer is not satisfactory in that the player must continue to tap for every beat. Also, it is substantially impossible to carry out ritardando, accelerando or the like since the tap tempo change tends to cause the timing clock to abruptly change in uncontinuous manner, which results in unnaturality of music.

SUMMARY OF THE INVENTION

It is therefore an object of the present invention to provide an automatic play device which, when operation for changing an automatic play tempo is effected, can change the tempo gradually and smoothly from one tempo to another corresponding to the change operation.

It is a further object of the present invention to provide an automatic play device which can realize a natural tempo change even when a tap is effected only at a desired beat and which can control stopping and restarting an automatic play in correspondence to a tap operation.

An automatic play device according to the present invention comprises a tempo signal generating section for generating a tempo signal at a frequency corresponding to a tempo setting value, an automatic tone generating section for automatically generating a tone in accordance with a tempo determined by said tempo signal, and a tempo change controlling section for, when change of the tempo setting value is effected, gradually changing a frequency of the tempo signal generated by the tempo signal generating section, from one frequency to another in correspondence to the change of the tempo setting value.

The tempo signal generating section generates the tempo signal at a frequency corresponding to the tempo setting value. This tempo setting value, as conventionally known, may be given in either of analog form or digital numerical value by operating an operator such as a knob or a switch or by other data input device. When this tempo setting value is changed, the tempo change controlling section controls the frequency of the tempo signal generated by the generating section in such manner that the frequency may be changed gradually, from one frequency corresponding to the tempo setting value not yet changed to another frequency corresponding to the tempo setting value already changed. In this way, when the tempo setting value is changed, the automatic play tempo does not immediately or abruptly change to a desired tempo, but instead, it does change gradually from one tempo to another tempo in correspondence to the tempo setting value change, with the result that a smooth tempo change can be effectively realized.

Further, an automatic play device according to the present invention prestores play data in a memory section and reads out the play data in a music procession order for automatic play, and it comprises a switch section that is operated for beating time, a detecting section for detecting when duration of a switch-on state of said switch section exceeds a predetermined time, and a adjusting section for stopping the automatic play at a next beat of the play data in response to detection by said detecting section. The device further includes a measuring section for measuring a measurement time until the switch section turns to the next switch-on state, and a tempo adjusting section for, when the measurement time is measured, changing the tempo in accordance with the measurement time and thereafter maintaining the tempo until a new measurement time is measured.

The detecting section detects when duration of the switch-on state of the switch section exceeds the predetermined time, and the adjusting section stops the automatic play at the next beat of the play data in response to detection by the detecting section, so that the automatic play can be automatically stopped. Also, the tempo adjusting section changes the tempo in accordance with the measurement time and thereafter maintains the tempo until a new measurement time is detected, so that a natural tempo change can be realized.

Now, embodiments of the present invention will be described with reference to the accompanying drawings.

BRIEF DESCRIPTION OF THE DRAWINGS

In the accompanying drawings,

FIGS. 21 and 22 show an example function of an embodiment shown in FIGS. 18–20.

DETAILED DESCRIPTION OF THE PREFERRED EMBODIMENTS

Figure 1:
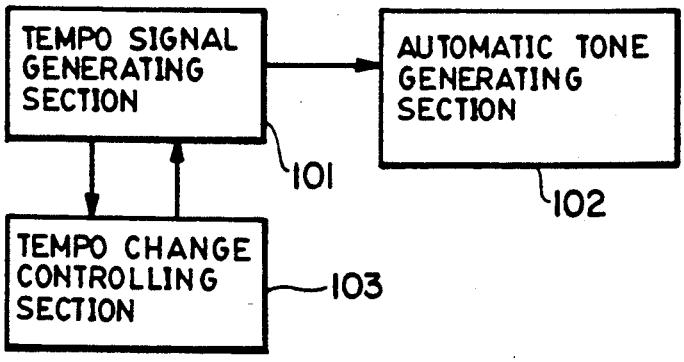
FIG. 1 is a block diagram showing an embodiment of the invention.

FIG. 1 generally illustrates a fundamental construction of an embodiment of an automatic play device according to the present invention. The device generally comprises a tempo signal generating section 101 for generating a tempo signal at a frequency corresponding to a tempo setting value, an automatic tone generating section 102 for automatically generating a tone in accordance with a tempo determined by the tempo signal, and a tempo change controlling section 103 for, when change of the tempo setting value is effected, gradually changing a frequency of the tempo signal generated by the tempo signal generating section 101, from one frequency to another in correspondence to the change of the tempo setting value.

Figure 2:
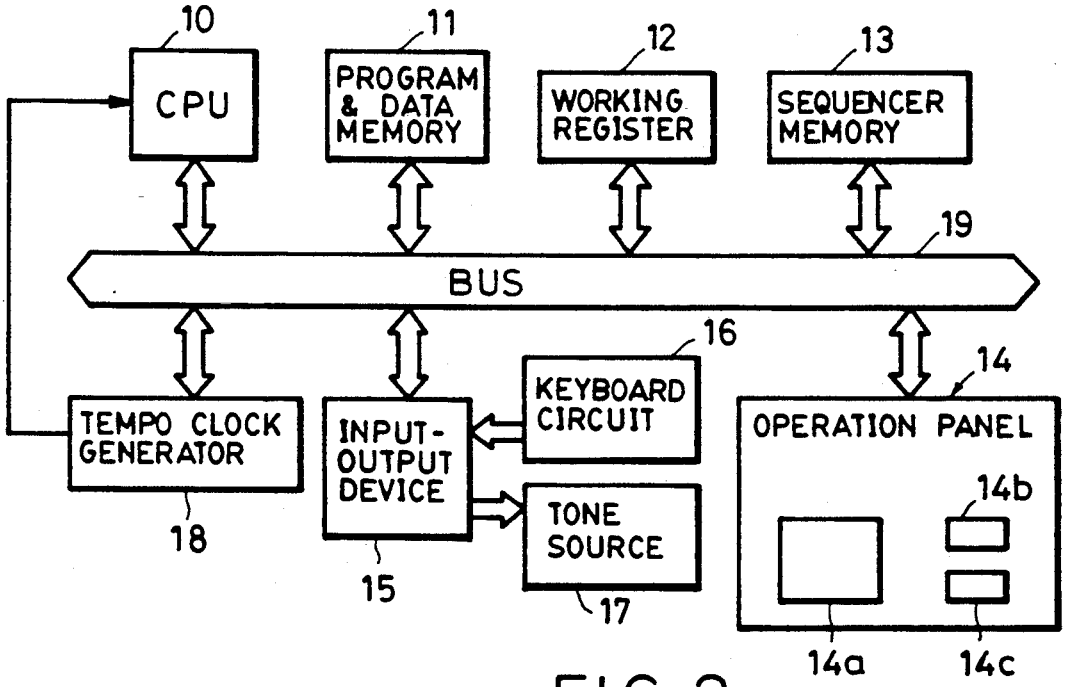
FIG. 2 is a block diagram showing a hardware construction of an embodiment of a musical instrument according to the invention.

FIG. 2 illustrates an embodiment of an automatic play device of the sequencer type. A microprocessor unit (CPU) 10 is provided for performing controls of the entire automatic play device. To this CPU 10 are connected via a bus 19 a program and data memory 11, a working register 12, a sequencer memory 13, an operation panel 14, an input-output device 15, and a tempo clock generator 18. In this embodiment, the components indicated by reference characters 10–15, 18 and 19 constitute a sequencer module, to which modules of a keyboard 16 and a tone source 17 are connected via the input-output device 15. The data exchanges among individual modules are done in accordance with the well-known MIDI (Musical Instrument Digital Interface) standard.

The program and data memory 11 stores various programs and data to be used by the CPU 10, and it comprises a read only memory (ROM). The working register 12 is provided for temporarily storing various data generated when the CPU 10 carries out the programs, and predetermined address areas of a random access memory (RAM) are reserved as this register 12. The sequencer memory 13 comprises a random access memory (RAM) and stores play data.

The operation panel 14 includes various kinds of operators for selecting, setting or controlling tone color, tone volume, tone pitch, tone effects or the like; for example, as a group of tempo setting operators, it has a tempo setting operator **14*a*, a tempo change coefficient setting operator 14*b* and a tempo followability setting operator 14*c*, the tempo setting operator 14*a*** being used for setting a desired tempo.

The input-output device 15 is provided for implementing the input and output of play data expressed in accordance with the MIDI standard. With this device 15, the keyboard circuit 16 provided for inputting desired play data into the sequencer module and also the tone source 17 that receives play data outputted from the sequencer module can be connected. Of course, for the purpose of inputting desired play data, a computer etc. can be connected in place of the keyboard circuit 16.

The keyboard circuit 16 comprises a plurality of key switches that are provided in corresponding relations with respective keys on a keyboard for designating the tone pitch of a tone to be generated. The keyboard circuit 16 outputs key-on event data when a key has been newly depressed and outputs key-off event data when a key has been newly released. The circuit 16 also performs a touch data generation process by determining the velocity of key depression, the magnitude of key depression force or the like, and it outputs thus generated touch data as velocity data. The key-on, key-off and velocity data are expressed in accordance with the MIDI standard and contain data indicative of a key code and an assigned channel as described later.

The tone source 17, which is capable of generating tone signals simultaneously in a plurality of channels, receives play data (data prepared in accordance with the MIDI standard) and generates a tone signal on the basis of this data. In the tone source 17, and any known system of tone signal generation may be employed as required. Namely, the system may be, for example, the memory read-out system in which tone waveshape sample value data stored in a waveshape memory is sequentially read out in accordance with address data that changes in correspondence to the tone pitch of a tone to be generated, or, the FM system in which predetermined frequency modulation operation is performed utilizing the abovementioned address data as phase parameter data so as to obtain tone waveshape sample value data, or, the AM system in which predetermined amplitude modulation operation is performed utilizing the abovementioned address data as phase parameter data so as to obtain tone waveshape sample value data. A digital tone signal generated in the tone source 17 is converted to an analog tone signal through a digital-to-analog converter (not shown) and is sounded by a sound system (also not shown).

The tempo clock generator 18 generates a tempo clock pulse at a selected frequency for counting a time interval or setting a tempo for automatic play, and the frequency of the tempo clock pulse can be set and adjusted by means of the tempo setting operators 14*a*, 14*b*, 14*c*. The tempo clock pulse generated by the generator 18 is given to the CPU 10 as an interruption signal so that an automatic play process can be carried out by an interruption process.

Automatic play data to be stored in the sequencer memory 13 is data that represents a play sequence. In the record mode, play data is sequentially stored in the memory 13 in accordance with the player's actual playing, while in the play mode, the stored data of the memory 13 is sequentially read out in response to the abovementioned tempo clock. The play data to be stored in the memory 13 is various data based on the events in the keyboard circuits 16 and operation panel 14. To be more specific, the sequencer memory 13 stores key-on event data when a keyboard key has been newly depressed and stores key-off event data when a keyboard key has been newly released, and also stores time data indicative of a time interval between those events. The process for recording those automatic play data is known and hence will not be described in detail.

Figure 3:
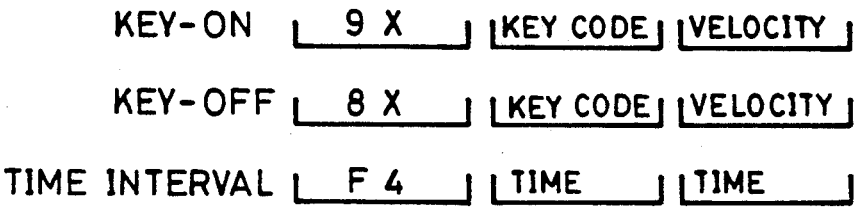
FIG. 3 shows example data format of play data to be stored in a sequencer memory in FIG. 2, expressed in accordance with the MIDI standard.

The play data to be stored in the sequencer memory 13 is for example in the data format of the MIDI standard. FIG. 3 illustrates examples of the respective data formats of the key-on, key-off and time interval data. The first byte of each data is a status byte (a byte utilized for an identification code indicative of the nature of a message), and the following second and third bytes are data bytes.

The first byte of the key-on data, namely, key-on event data is composed of "9" representing key-on data and "X" indicating the number of the MIDI channel to which the key-on event has been assigned, and thus the identification code of this data is "9X". The first byte of the key-off data, namely, key-off event data is composed of "8" representing the key-off data and "X" indicating the number of the MIDI channel to which the key-off event has been assigned, and thus the identification code of this data is "8X". The second byte of each of the key-on and key-off data indicates the key code of the key concerned, and the third byte indicates velocity data which is the touch data of the key.

Although not defined in the MIDI standard, the identification code "F4" in the first byte of the time interval data is used in the embodiment as an identification code byte for the time interval indicating a timing at which a tone is to be generated. The time interval is indicated by the upper 7 bits of the second byte and the lower 7 bits of the third byte.

As set forth above, one unit of the event data or the time interval data comprises three-byte data. In the sequencer memory 13, one address designated by a pointer is used for one byte, so that one unit of the event data or the time interval data comprising three-byte data is stored in successive three pointer addresses.

In this embodiment, the sequencer memory 13 has a memory capacity of thirty-two tracks. Each track corresponds to one play part, and tones can be simultaneously generated in sixteen channels for each track. In other words, one play part is a sixteen-channel polyphonic part. The channel "X" in the first byte of the MIDI standard indicates one of the sixteen channels within the MIDI. The sequencer memory 13 stores sequential play data at each track, and reads out the stored play data of each track for reproduction.

In this embodiment, when change of the tempo setting value is effected by operating the tempo setting operator 14*a*, the tempo clock frequency is caused to shift gradually from one frequency corresponding to the previous (unchanged) tempo setting value, to another frequency corresponding to the new (changed) tempo setting value.

Figure 4A:
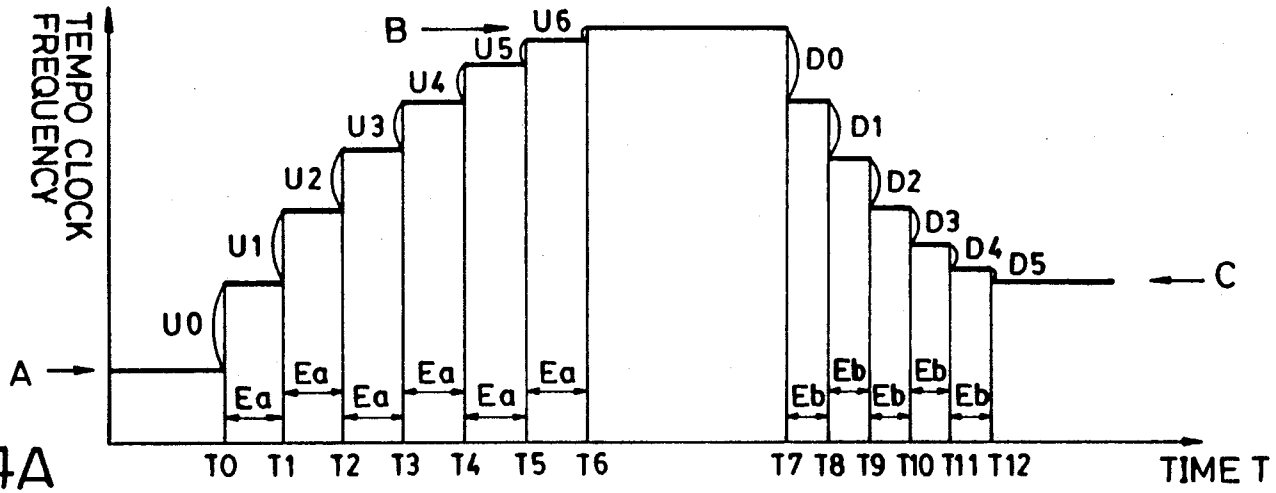
FIGS. 4A and 4B show a concept of tempo change processing of the invention.
Figure 4B:
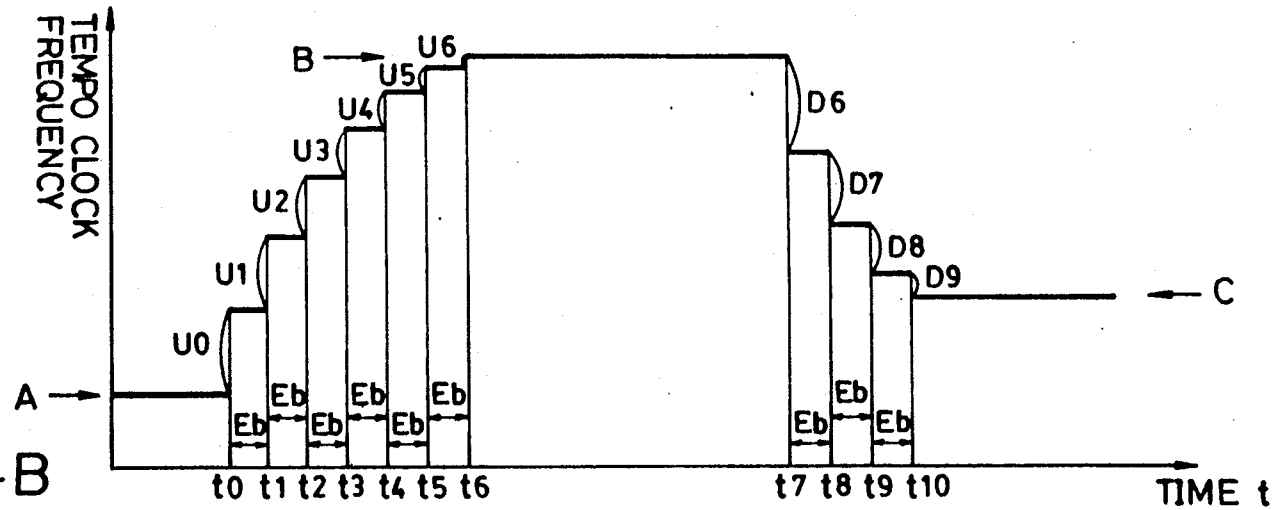

Example manners how the frequency is shifted and interpolation is made in the case will now be outlined with reference to FIGS. 4A and 4B, in each of which the horizontal axis denotes time, and the vertical axis denotes tempo clock frequency. In each of the figures, a case is illustrated where the tempo clock frequency is first increased from A to B and then decreased from B to C.

When operation has been made for increasing the tempo clock frequency from A to B in FIG. 4A, namely, there has occurred a tempo setting event for increasing the tempo by means of the tempo setting operator 14*a*, the tempo clock frequency is increased by the tempo increase amount U0 at time T0 to take the value of A+U0, this value of A+U0 being maintained for a unit time interval Ea (between times T0 and T1). Next, at time T1, the tempo clock frequency is increased by the tempo increase amount U1 to take the value of A+U0+U1, and this value of A+U0+U1 being maintained for a unit time interval Ea. After that, the increase amounts U2, U3, U4, U5 and U6 are likewise added to the tempo clock frequency as the time passes, and thus the frequency is increased gradually until it reaches the target tempo clock frequency B at time T6. In this example, the tempo increase amounts U1, U2, U3, U4, U5, U6 are predetermined to become gradually smaller in the order of mention so that the tempo clock frequency increase follows a logarithmic curve.

After the desired tempo-up (tempo increase) is completed in the abovementioned manner, the tempo clock frequency B is maintained at a fixed value for a period between times T6 and T7. Subsequently, when there has occurred at time T7 a tempo setting event for decreasing the tempo, the tempo clock frequency is, in the reversed manner from the above, decreased by the tempo decrease amount D0 at time T7 to take the value of B-D0, this value of B-D0 being maintained for a unit time interval Eb (between times T7 and T8). Then, at time T8, the tempo clock frequency is decreased by the tempo decrease amount D1 to take the value of B-D0-D1, this value of B-D0-D1 being maintained for a unit time interval Eb. After that, the tempo decrease amount D2, D3, D4 and D5 are subtracted from the tempo clock frequency as the time passes, and thus the tempo clock frequency is decreased gradually unit it reaches the target tempo clock frequency C at time T12. The tempo decrease amounts D1, D2, D3, D4 and D5 are determined so as to become gradually smaller in the order of mention.

The unit time interval Eb for the tempo decrease is determined to be shorter than the unit time interval Ea for the tempo increase, and hence the tempo clock frequency is decreased at a higher speed than when it is increased. It means that the change rate at which the tempo is made faster is smaller than the change rate at which the tempo is made slower.

Similarly, in the example shown in FIG. 4B, the tempo clock frequency is caused to shift in the order of A, B, C, but a unit time interval Eb for the tempo increase is equal to a unit time interval Eb for the tempo decrease. Accordingly, if a tempo setting event occurs simultaneously at time T0 and t0 respectively in both the examples of FIGS. 4A and 4B, the target tempo clock frequency B can be reached earlier in the example of FIG. 4B than in the example of FIG. 4A. Further, the respective tempo decrease amounts D6, D7, D8, D9 in the example of FIG. 4B are predetermined to become greater than the corresponding decrease amounts in the example of FIG. 4A. Accordingly, if the decrease commences simultaneously at time T7 and t7 in both the examples of FIGS. 4A and 4B, the tempo block frequency C can be reached earlier in the example of FIG. 4B than in the example of FIG. 4A. It means that also in the example of FIG. 4B, the change rate at which the tempo is made faster is smaller than the change rate at which the tempo is made slower.

Thus, according to this embodiment, the change rate at which a certain tempo clock frequency shifts to the target tempo clock frequency can be variably set and the tempo clock frequency shift following a desired change curve characteristic can be implemented, by predetermining as desired the tempo increase and decrease amounts (those being hereinafter referred to as tempo change amounts) or the unit time intervals for the tempo increase and decrease. The unit time intervals Ea, Eb for the tempo increase and decrease will be hereinafter referred to as tempo followability, because the time required for the complete tempo shift, namely, the tempo followability with respect to tempo clock frequency changing operation is determined by controlling the lengths of such time intervals. Specific processes in accordance with the tempo increase and decrease amounts and the tempo followability will be described later.

Examples of various processes in the automatic play device of FIG. 2 that are performed by the CPU 10 will now be described on the basis of flow charts shown in FIGS. 5–15.

Before getting down to the point, the contents of the working register 12 will be described. The following registers are arranged in the working register 12:

FLG: Identification code register that temporarily stores an identification code in the first byte of a unit play data;

MD(TRK): Action mode register that stores, for each track, an action mode currently selected from among a reproduction mode, record mode, stop mode etc.;

POINT(TRK): Pointer that designates, for each track, an address of the sequencer memory 13;

PRI: Process mode register that indicates whether the currently selected process mode is a preset mode in which tempo change coefficient and tempo followability data preset in the program and data memory 11 are used, or a manual mode in which tempo change coefficient and tempo followability set as desired by a user are used. This register stores "1" when the current mode is the preset mode and stores "0" when the current mode is the manual mode;

KCD: Key code register that temporarily stores a key code;

VEL: Velocity register that temporarily stores velocity data;

TNOW: Tempo setting register that temporarily stores tempo data for setting a tempo clock frequency, namely, data indicative of the current tempo setting value;

TNEW: Target tempo register that temporarily stores target tempo data indicative of a target tempo for tempo change;

TRK: Track number register that designates the number (1–32) of a track which is currently processed;

TIME(TRK): Time interval register that temporarily stores, for each track, data indicative of a time interval between successive play events;

UPC: Tempo-up coefficient register that is used when the tempo clock frequency is increased and stores a tempo-up coefficient for determining the tempo increase amount set as desired by the user;

DNC: Tempo-down coefficient register that is used when the tempo clock frequency is decreased and stores a tempo-down coefficient for determining the tempo decrease amount set as desired by a user;

EU: Tempo-up followability register that stores tempo followability data (for example, the unit time interval Ea or Eb of FIG. 4A or 4B) for the tempo-up change set as desired by the user;

ED: Tempo-down followability register that stores tempo followability data (for example, the unit time interval Eb of FIG. 4A or 4B);

EXU: Tempo-up time measuring register that stores the tempo followability data in the tempo-up followability register EU to decrement the data;

EXD: Tempo-down time measuring register that stores the tempo followability data in the tempo-down followability register ED to decrement the data; and EXPRI: Time measuring register that stores tempo followability data EPRI prestored in the program and data memory 11 to decrement the data.

Further, in the program and data memory 11 are prestored such data as tempo-up coefficient data UPCX and tempo-down coefficient data DNCX which correspond, respectively, to the tempo-up coefficient stored in the tempo-up coefficient register UPC and the tempo-down coefficient stored in the tempo-down coefficient register DNC, and tempo followability data which corresponds to the tempo followability data in the above mentioned tempo-up and tempo-down followability registers EU, ED. The tempo followability data stored in the program and data memory 11 is used in common for both the tempo-up and tempo-down changes.

Figure 5:
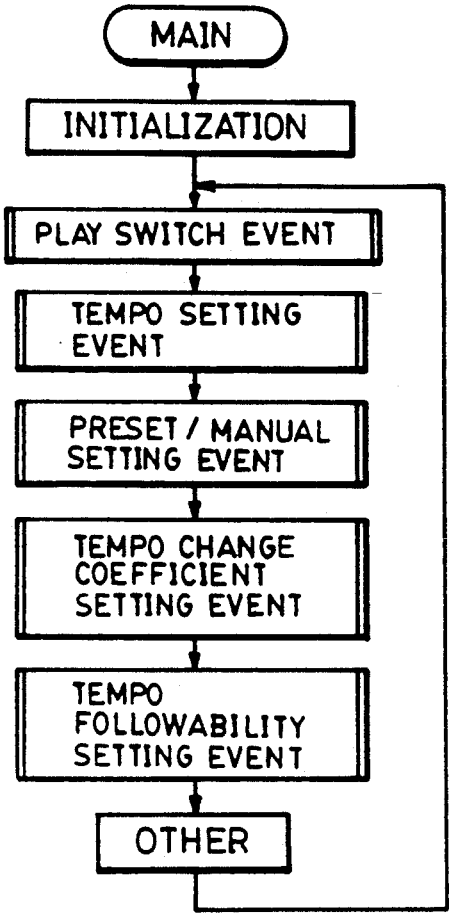
FIG. 5 is a flow chart showing an example of a main routine performed by a CPU shown in FIG. 2.

FIG. 5 shows an example of the main routine performed by the CPU 10.

Upon switch-on of the power, the CPU 10 start processes corresponding to the control program stored in the program and data memory 11. In an initialization process, the working register 12 is initialized. After the initialization process, a play switch event process, a preset/manual setting event process, a tempo change coefficient setting event process, a tempo followability setting event process and other processes (i.e., other operation event processes such as a record switch process, a stop switch process and a ten key input process) are repeatedly performed in response to the respective events.

Figure 6:
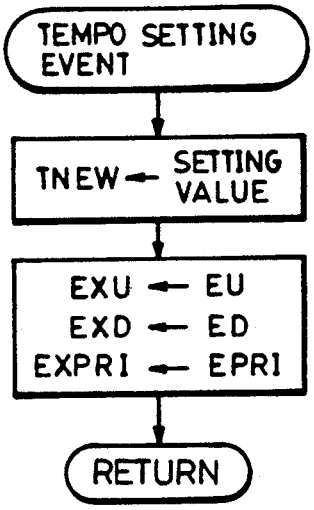
FIG. 6 is a flow chart showing a detailed example of a tempo setting event process shown in FIG. 5.
Figure 7:
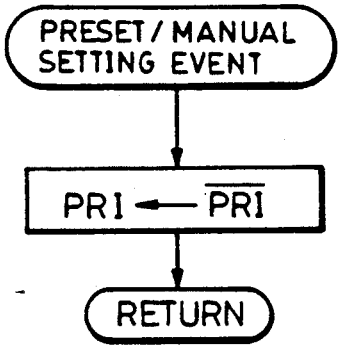
FIG. 7 is a flow chart showing a detailed example of a preset/manual setting event process shown in FIG. 5.
Figure 8:
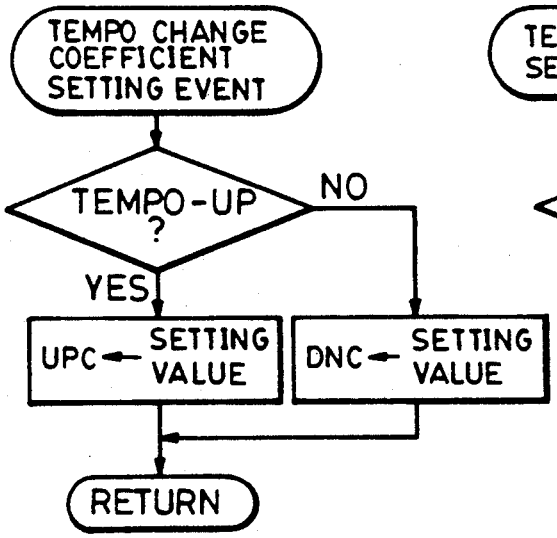
FIG. 8 is a flow chart showing a detailed example of a tempo change coefficient setting event process shown in FIG. 5.
Figure 9:
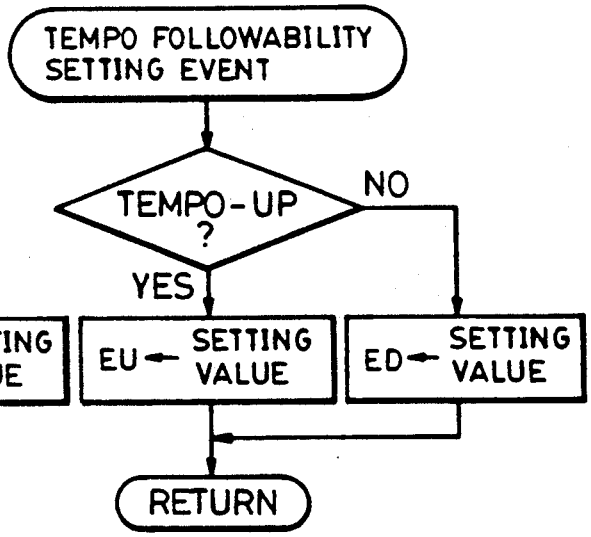
FIG. 9 is a flow chart showing a detailed example of a tempo followability setting event process shown in FIG. 5.
Figure 10:
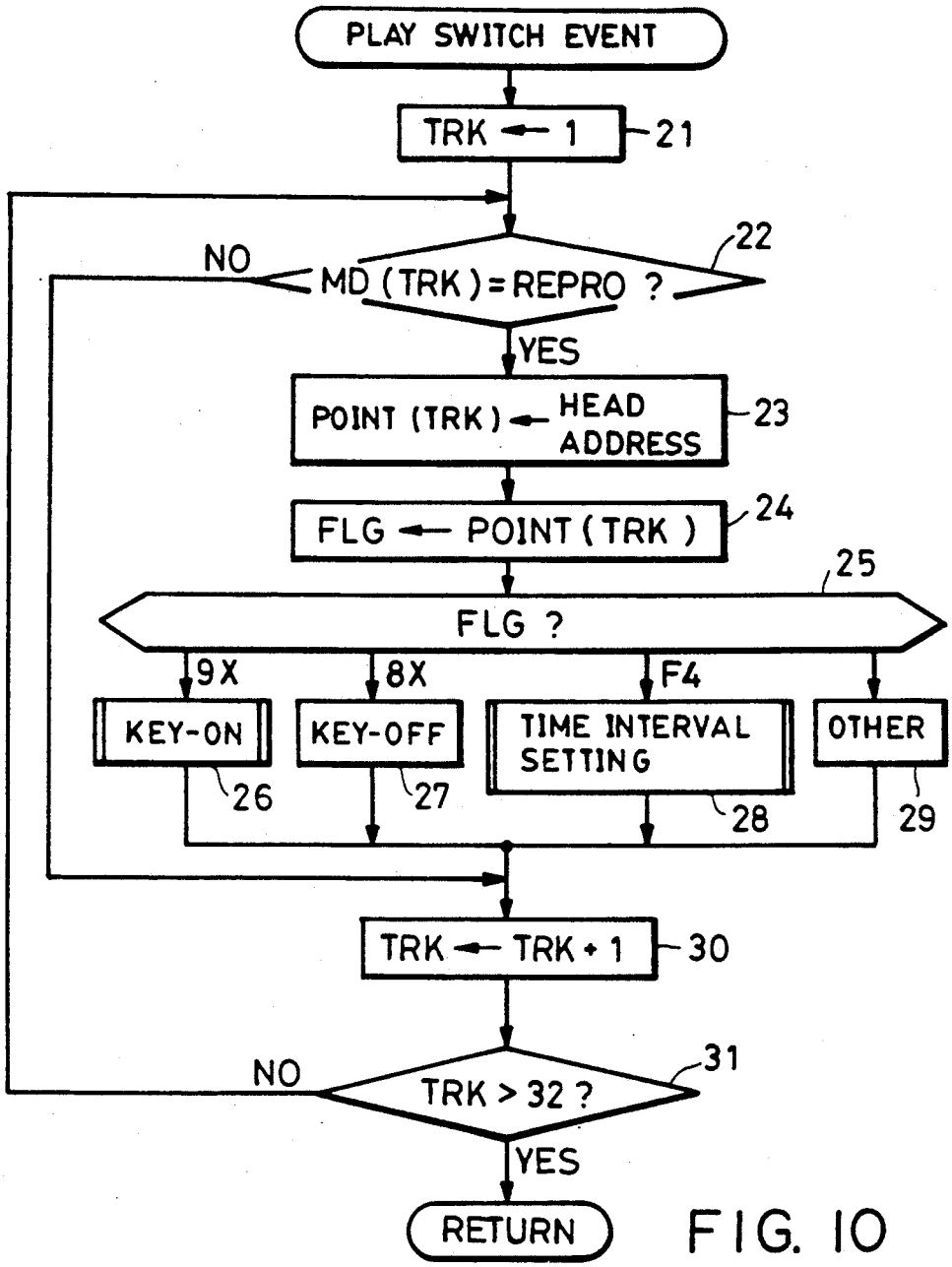
FIG. 10 is a flow chart showing a detailed example of a play switch event process shown in FIG. 5.

The play switch event process is performed for starting an automatic play (reproduction) when a play (reproduction) switch on the operation panel 14 has been operated. An example of the play switch event process is shown in FIG. 10. The tempo setting event process is performed when operation to change the tempo setting value has been made by means of the tempo setting operator 14*a* on the operation panel 14. An example of the tempo setting event process is shown in FIG. 6. The preset/manual setting event process is performed when a process mode selecting switch on the operation panel 14 has been operated. An example of the preset/manual setting event process is shown in FIG. 7. The tempo change coefficient setting event process and the tempo followability setting event process are performed respectively when operations to set the tempo change coefficient or followability data have been made by means of the operators 14*b*, 14*c* on the operation panel 14. Examples of these processes are shown in FIGS. 8 and 9. In the other processes, such processes based on operations of the other operators on the operation panel 14 and various other processes are performed.

In the tempo setting event process shown in FIG. 6, a tempo setting value newly set by means of the tempo setting operator 14*a* is stored as target tempo data in the target tempo register TNEW, the tempo followability data of the tempo-up followability register EU and the tempo-down followability register ED are stored in the tempo-up time measuring register EXU and the tempo-down time measuring register EXD, respectively, and the tempo followability data EPRI within the program and data memory 11 is stored in the time measuring register EXPRI. With thus stored data, it becomes possible to make the rates for the tempo-up and tempo-down changes different from each other when the tempo change operations are made in the manual mode.

In the preset/manual setting event process shown in FIG. 7, the contents of the process mode register PRI is inverted to the preset mode or the manual mode whenever the process mode selecting switch has been operated.

In the tempo change coefficient setting event process shown in FIG. 8, a tempo change coefficient for the manual mode is set in the tempo-up coefficient register UPC or in the tempo-down coefficient register DNC. First, it is determined whether or not the setting event by means of the tempo change coefficient setting operator 14*b* is a coefficient setting operation directed to the tempo-up change. If the determination result is YES, the tempo change coefficient set by the tempo change coefficient setting operator 14*b* is stored into the tempo-up coefficient register UPC; if, on the other hand, the result is NO, the set tempo change coefficient is stored into the tempo-down coefficient register DNC.

In the tempo followability setting event process shown in FIG. 9, tempo followability data for the manual mode is set in the tempo-up and tempo-down followability register EU, ED. To do this, it is first determined whether or not the setting event operation by the tempo followability setting operator 14*c* is a followability setting operation directed to the tempo-up change. If the determination result is YES, the tempo followability data set by the tempo followability setting operator 14*c* is stored into the tempo-up followability register EU; if, on the other hand, the result is No, the followability data is stored into the tempo-down followability register ED.

As for the example of FIG. 4A, substantially same values are respectively set in the tempo-up and tempo-down coefficient registers UPC, DNC in the process of FIG. 8, and the unit time interval Ea is set in the tempo-up followability register EU and the unit time interval Eb shorter than the interval Ea is set in the tempo-down followability register ED in the process of FIG. 9. Thus, in the example of FIG. 4A, although the tempo increase amount for the tempo clock frequency increase and the tempo decrease amount for the tempo clock frequency decrease are substantially the same, the frequency increase takes place more slowly than the frequency decrease due to difference in the time intervals (followabilities).

As for the example of FIG. 4B, a smaller value than the value of the tempo-down coefficient register DNC is set in the tempo-up coefficient register UPC in the process of FIG. 8, and substantially same time intervals Eb are respectively set in the tempo-up and tempo-down followability register EU, ED. Thus, in the example of FIG. 4B, although the unit time intervals are the same for the tempo clock frequency increase and decrease, the frequency increase takes place more slowly than the frequency decrease because the tempo increase amount is smaller than the tempo decrease amount.

Individual steps of the play switch event process will now be described with reference to FIG. 10.

Step 21: "1" is set in the track number register TRK to start processes for the first track.

Step 22: It is determined whether or not the value stored in the action mode register MD(TRK) is the one indicative of the reproduction mode. If the determination result is YES, next step 23 is implemented; however, if the determination result is NO (the value is indicative of the record or stop mode other than the reproduction mode), step 30 is implemented. The action mode register MD(TRK) is provided for each track, and in this step 22 the action mode of the track designated by the track number register TRK is examined. A track to be reproduced can be designated as desired by enabling an action mode to be set for each track in this manner, but detailed explanation on the process for enabling an action mode to be set for each track will be omitted.

Step 23: The head address of the sequencer memory 13 associated with the track designated by the track number register TRK is stored into the pointer POINT(TRK).

Step 24: Play data in the sequencer memory 13 corresponding to the address indicated by the pointer POINT(TRK) is stored into the identification code register FLG.

Step 25: The identification code of the play data stored in the identification code is examined, and different steps are implemented depending on the identification code.

Figure 11:
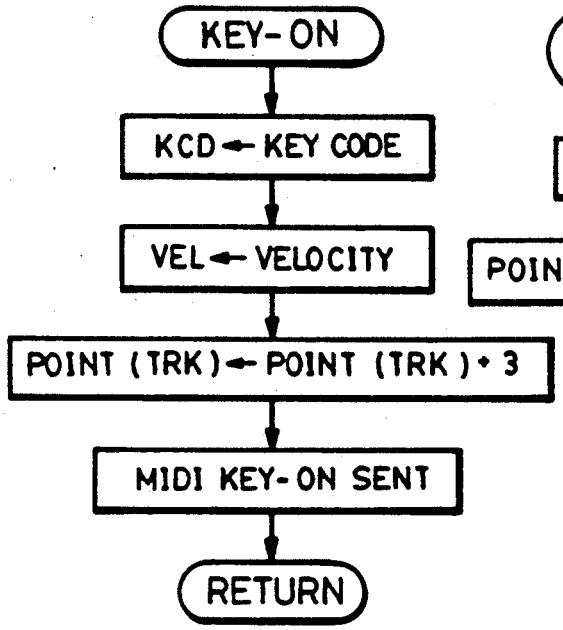
FIG. 11 is a flow chart showing a detailed example of a key-on event subroutine shown in FIGS. 10 and 14.

Step 26: This step is taken if the identification code is "9X" indicative of a key-on event, and in this step a key-on event subroutine shown in FIG. 11 is implemented.

Step 27: This step is taken if the identification code is "8X" indicative of a key-off event, and in this step a key-off process is implemented. The key-off process is substantially similar to the key-on process, and hence its details will not be described.

Step 28: This step is taken if the identification code is "4X" indicative of time interval data, and in this step time interval setting subroutine is implemented.

Step 29: This step is taken if the identification is a code other than the abovementioned, and in this step different processes are implemented depending on the identification code. Such different processes will not be described.

Step 30: "1" is added to the contents of the track number register TRK to increase the track number by one.

Figure 13:
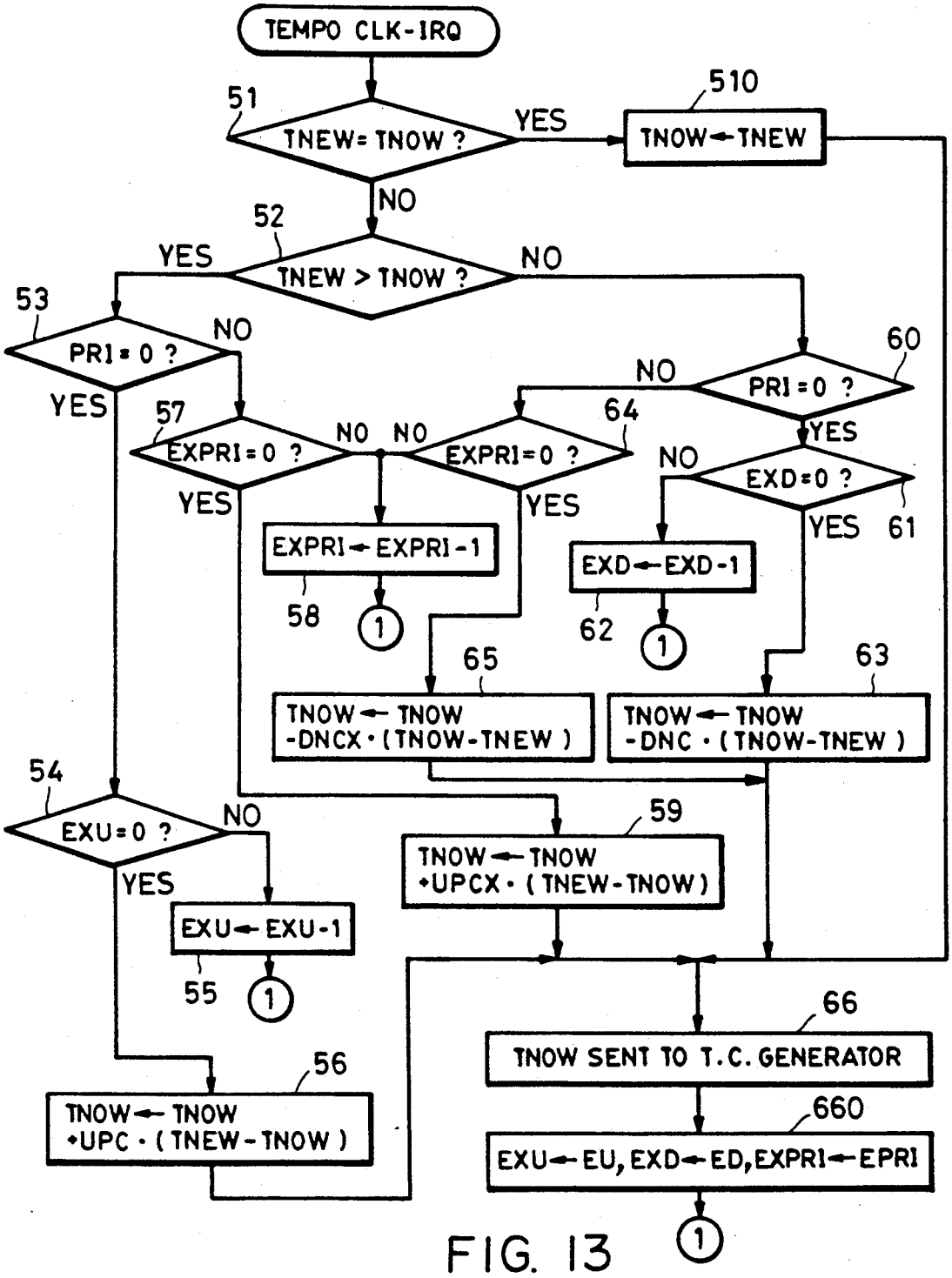
FIGS. 13 and 14 is a flow chart showing an example of a tempo clock interruption process.
Figure 14:
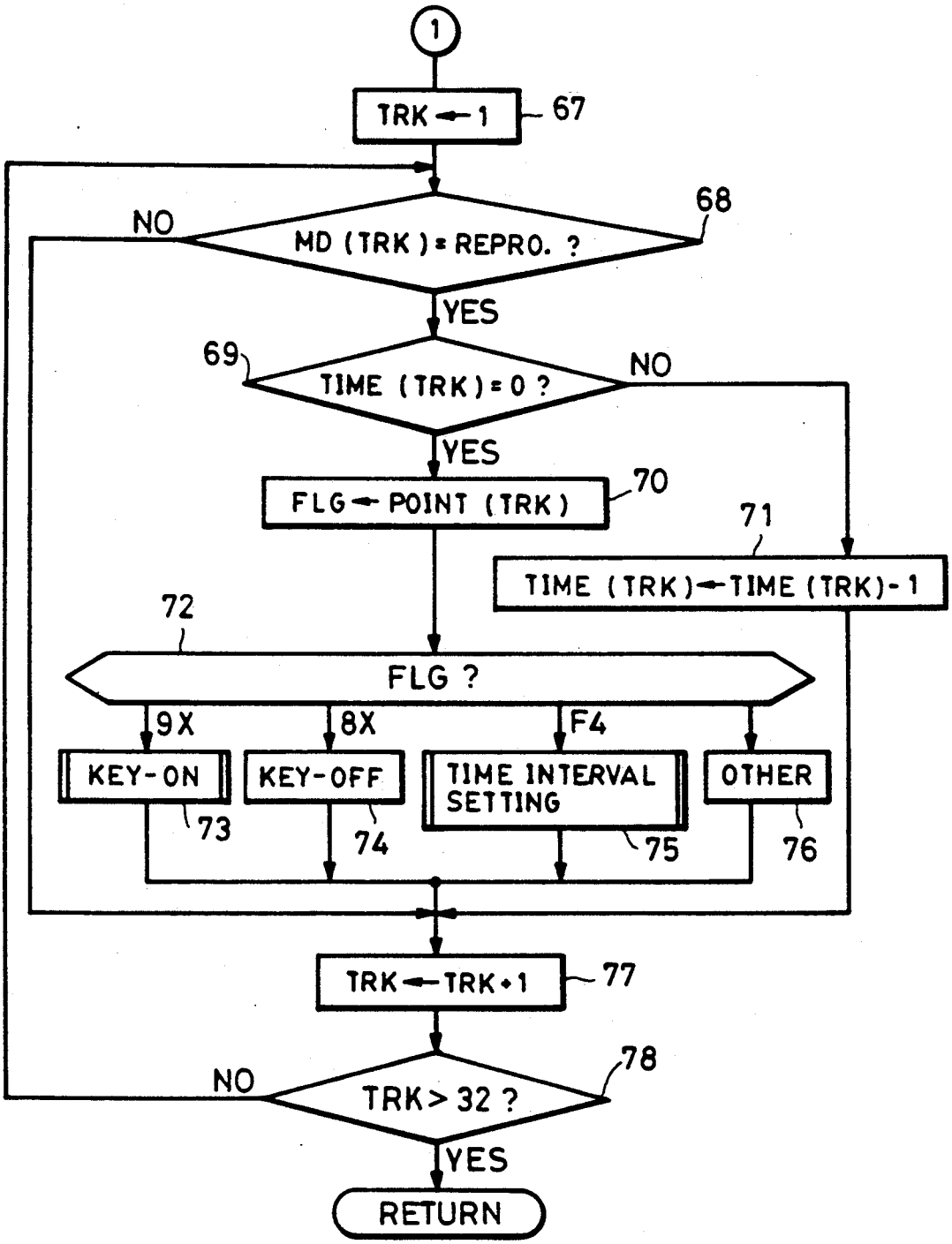

Step 31: It is determined whether or not the increased value of the track number register TRK is not greater than 32 which is the maximum number of the sequencer tracks. If the increase value is smaller than 32, the flow returns to step 22 so that processes similar to the abovementioned are implemented with respect to the increased track number; however, if the increased value is greater than 32, it is meant that the processes related to the head addresses of all the tracks have been completed and thus the flow returns to the main routine, after which process shown in FIGS. 13 and 14 is performed as an interruption process based on the tempo clock.

Next, the key-on event subroutine performed in step 26 of FIG. 10 or in step 73 of FIG. 14 will be described in detail with reference to FIG. 11.

First, if the contents of the identification code register FLG indicates "key-on", the key code data in the second byte of the key-on data (see FIG. 3) that is based on the MIDI standard is stored into the key code register KCD, and the velocity data in the third byte of the key-on data is stored into the velocity register VEL. Then, "3" is added to the contents of the pointer POINT(TRK) to increment the stored track number by 3. The reason why the track number is incremented by 3 is that the second and third byte data, namely, the key code and velocity data need be skipped so that the pointer POINT(TRK) may next indicate the address of the status (first) byte of the next play data. Next, a MIDI key-on message that includes the key code data stored in the key code register KCD during the first process and the velocity data stored in the velocity register VEL during the next process are sent out to the tone source 17 via the input-output device 15, and thus the tone source 17 can generate a tone signal based on the key-on message.

Figure 12:
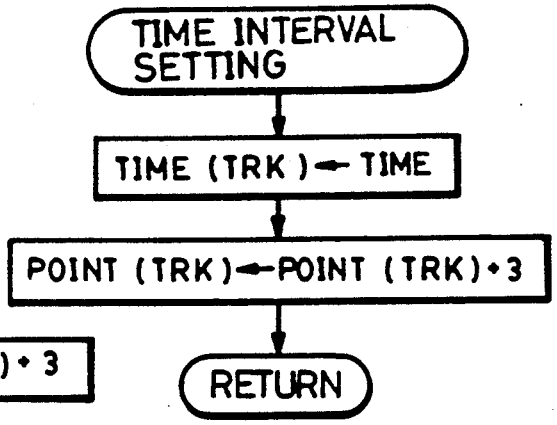
FIG. 12 is a flow chart showing a detailed example of a time interval setting subroutine shown in FIGS. 10 and 14.

The time interval setting subroutine which is performed in step 28 of FIG. 10 or in step 75 of FIG. 14 will now be described with reference to FIG. 12. This process is performed in the case where the contents of the identification code register FLG indicated time interval data. In this process, the time interval data in the second and third bytes of the time interval message is stored into the time interval register TIME(TRK) associated with the track designated by the track number register TRK. Then, 3 is added to the contents of the pointer POINT(TRK) of the track to increase the address of the sequencer memory 13 by 3 so that the first byte of the next play data may be indicated.

The play switch event routine shown in FIG. 10 is performed only once when the play switch has been turned on. After that, a tempo clock interruption routine as shown in FIG. 13 or 14 is repeatedly performed in accordance with the tempo clock interruption: this routine is performed each time a tempo clock from the tempo clock generator 18 is applied to the CPU 10. In steps 51 and 52, the values of the tempo setting register TNOW and the target tempo register TNEW are compared with each other, and different branches are performed depending on the comparison result.

Step 51: If the values stored in the tempo setting register TNOW and the target tempo register TNEW are equivalent to each other, the subsequent tempo change operations of steps 52–63 are not performed, but the value of the target tempo register TNEW is set in the tempo setting register TNOW, and the flow jumps to step 66, in which step the value of the tempo setting register TNOW is directly sent out to the tempo clock generator 18. On the other hand, if the values of the tempo setting register TNOW and the target tempo register TNEW are not equivalent, the flow advances to next step 52.

Step 52: It is determined whether or not the value stored in the target tempo register TNEW is greater than that stored in the tempo setting register TNOW. If the former is greater than the latter, the flow advances to the operations of step 53 and following other steps for the tempo-up change; if, on the other hand, the former is not greater than the latter, the flow advances to the operations of step 60 and following other steps. Accordingly, in the example of FIG. 4A or 4B, if the tempo clock frequency A has been stored into the tempo setting register TNOW and the tempo clock frequency B has been stored into the target tempo register TNEW, then the tempo-up operations of step 53 and following other steps will be implemented; if, on the other hand, the tempo clock frequency B has been stored into the tempo setting register TNOW and the tempo clock frequency C has been stored into the target tempo register TNEW, then the tempo-down operations of step 60 and following other steps will be implemented.

Next, the tempo-up operations of step 53–59 will be described.

Step 53: It is determined whether or not the value of the process mode register PRI is "0", namely, it is currently indicative the manual mode. If the value is currently indicative of the manual mode, the flow advances to step 54; if not, the flow advances to step 53. It means that the operations of steps 54–56 are implemented in the case of the manual mode, while the operations of steps 57–59 are implemented in the case of the preset mode.

Step 54: It is determined whether or not the tempo-up change can be immediately implemented, namely, whether or not the value of the tempo-up time measuring register EXU is "0". If the result is NO, i.e., the value is not "0", it is meant that the current operation time is in the midst of the unit time interval Ea or Eb of FIGS. 4A and 4B, and hence the value of the tempo clock frequency must be fixedly maintained without being changed. Thus, if the result is NO in this step, the flow advances to step 55, in which step countdown of the tempo-up time measuring register EXU is done. On the other hand, if the result is YES, i.e., the value of the tempo-up time measuring register EXU is "0", it is meant that the current operation time corresponds to one of the times T0–T6 or t0–t6 of FIGS. 4A and 4B, and hence the flow advances to step 56, in which step tempo increase amount at the current time is calculated.

Step 55: "1" is deducted from the tempo-up time measuring register EXU, and the flow jumps to step 67 of FIG. 14.

Step 56: The value of the tempo clock frequency to be used after the tempo-up change is calculated by means of the tempo setting register TNOW, target tempo register TNEW and tempo-up coefficient register UPC. In more specific terms, the value of the tempo setting register TNOW is subtracted from the value of the target tempo register TNEW, and the subtraction result (difference) is multiplied by the value of the tempo-up coefficient register UPC. Then the multiplication result (product) is added to the value of the tempo setting register TNOW, and the addition result (sum) is stored as the new value of the tempo setting register TNOW. In other words, in this step, the tempo increase amount U0 is calculated, and its value is added to the value of the unchanged, previous tempo clock frequency. It is to be noted that with the calculation of UPC×(TNEW-TNOW) in this step, the tempo increase amounts U0, U1, U2—can be made gradually smaller. Upon completion of the calculation, the flow advances to step 66.

The operations of steps 57–59 are implemented if the determination result in step 53 shows the selection of the preset mode, and these operations will be described only briefly since they are substantially the same as the abovementioned operations of steps 54–55.

Step 57: It is determined whether or not the value of the time measuring register EXPRI has become "0". If the determination result is NO, step 58 is taken; if, on the other hand, the determination result is YES, step 59 is taken.

Step 58: "1" is deducted from the tempo-up time measuring register EXPI, and the flow jumps over to step 67 of FIG. 14.

Step 59: The value of the tempo clock frequency after the tempo-up change is calculated by means of the tempo setting register TNOW, the target tempo register TNEW and the tempo-up coefficient data UPCX in the program and data memory 11, in a manner similar to step 56. Upon completion of the calculation, the flow advances to step 66.

Next, the tempo-down change operations of steps 60–65 will be described. These operations are substantially the same as those of steps 53–59.

Step 60: It is determined whether or not the value of the process mode register PRI is "0", namely, the current process mode is the manual mode. If the determination result YES, step 61 is taken; if NO, step 64 is taken. It means that the operations of steps 61–63 are implemented in the case of the manual mode, while the operations of steps 64, 65, 58 are implemented in the case of the preset mode.

Step 61: It is determined whether or not the tempo-down change operations can be immediately implemented, namely, whether or not the value of the tempo-down time measuring register EXD is "0". If the result is NO, it is meant that the current operation time is in the midst of the unit time interval Eb of FIGS. 4A and 4B, and hence the value of the tempo clock frequency must be fixedly maintained without being changed. Thus, if the result is NO, the flow advances to step 62, in which step countdown of the tempo-down time measuring register EXD is done. On the other hand, if the value of the tempo-down time measuring register EXD is "0" (the result is YES), it is meant that the current operation time corresponds to one of the time T7–T12 or t7–t10 of FIGS. 4A and 4B, and hence the flow advances to step 63, in which step tempo decrease amount at the current time is calculated.

Step 62: "1" is deducted from the contents of the tempo-down time measuring register EXD, and jump to step 67 of FIG. 14 is effected.

Step 63: The value of the tempo clock frequency after the tempo-down change is calculated by means of the tempo setting register TNOW, target tempo register TNEW and tempo-down coefficient register DNC. In more specific terms, the value of the target tempo register TNEW is subtracted from the value of the tempo setting register TNOW, and the subtraction result is multiplied by the value of the tempo-down coefficient register DNC. Then the value of the multiplication result is subtracted from the value of the tempo setting register TNOW, and this subtraction result) is stored as the new value of the tempo setting register TNOW. In other words, in this step, the tempo decrease amount D0 is calculated, and its value is subtracted from the value of the unchanged, previous tempo clock frequency. It is to be noted that with the calculation of DNC×(TNEW-TNOW) in this step, the tempo decrease amounts D0, D1, D2—can be made gradually smaller. Upon completion of the aforesaid calculation, the flow advances to step 66.

The operations of steps 64 and 65 will be described only briefly since they are substantially the same as the abovementioned operations of step 57 and 59.

Step 64: It is determined whether or not the value of the time measuring register EXPRI has become "0". If the determination result is NO, step 58 is taken; if, on the other hand, the determination result is YES, step 65 is taken.

Step 65: The value of the tempo clock frequency is calculated by means of the tempo setting register TNOW and target tempo register TNEW and the tempo-down coefficient data DNCX in the program and data memory 11, in a manner similar to step 63. Upon completion of the calculation, the flow advances to step 66.

Step 66: The tempo data newly set in the tempo setting register TNOW by step 56, 59, 63 or 65 is sent out to the tempo clock generator 18, so that the automatic play tempo is changed to such value as corresponding to the tempo data stored in the tempo setting register TNOW.

After step 66, the flow advances to step 660 and then to step 67 of FIG. 14. In step 660, the tempo followability data of the tempo-up and tempo-down followability registers EU, ED are stored into the tempo-up and tempo-down time measuring registers EXU, EXD, respectively, and the tempo followability data EPRI in the program and data memory 11 is stored into the time measuring register EXPRI. With this operation, the determination result in steps 54, 57, 61 or 64 will become NO at the next interruption so that countdown of the unit time interval may be implemented in the operation of steps 55, 58 or 62.

Next, the operations of steps 67–78 of FIG. 14 will be described.

Step 67: "1" is set into the track number register TRK to start the operations for the first track.

Step 68: It is determined whether or not the value stored in the action mode register MD (TRK) corresponding to the track designated by the track number register TRK is the one indicative of the reproduction mode. If the determination result is YES, next step 69 is taken; if, on the other hand, the determination result is NO, step 77 is taken.

Step 69: It is determined whether or not the value of the time interval register TIME(TRK) corresponding to the track designated by the track number register TRK is "0". If the value is "0", step 70 is taken; if the value is not "0", step 71 is taken. That the value of the register TIME(TRK) is not "0" indicates that a time interval between play events is currently being counted, while that the value is "0" indicates that the counting of such time interval has been completed.

Step 70: If the value of the time interval register TIME(TRK) is determined as "0", the identification code of the next play data is read out from the first byte of the next play data indicated by the pointer POINT(TRK) and stored into the identification code register FLG so that the next play data may be read out from the sequencer 13.

Step 71: If the value of the time interval register TIME(TRK) is determined as not "0" in step 69, "1" is deducted from the value of the register TIME(TRK) and step 77 is taken. In other words, the time count is performed by decrementing the time interval data in response to the tempo clock pulse.

Step 72: The identification code of the play data data stored in the identification code register FLG is examined, and different steps are taken depending on the examined identification code.

Step 73: This step is taken in the case where the identification code is "9X" indicative of a key-on event, and the key-on event subroutine shown in FIG. 11 is performed in this step.

Step 74: This step is taken in the case where the identification code is "8X" indicative of a key-off event, and the key-off process is performed in this step.

Step 75: This step is taken in the case where the identification code is "F4" indicative of the time interval data, and the time interval setting subroutine is performed in this step.

Step 76: This step is taken in the case where the identification code is the one other than the abovementioned codes, and different operations are performed depending on the identification code.

Step 77: "1" is added to the contents of the track number register TRK to increment the track number by one.

Step 78: It is determined whether or not the incremented value of the track number register TRK is greater than 32, the maximum number of the tracks. If the value is not greater than 32, the flow returns to step 68 so that operations similar to the above may be repeated for the track of the incremented track number.

If, on the other hand, the value is greater than 32, the flow returns to the main routine because it is meant that the processes for the entire tracks have been completed. After that, the process will be performed again in response to the generation of the next interruption signal.

Now, the overall function for reproduction or automatic play will be described.

First, when the selection of the preset mode or the manual mode has been made by the user, the contents of the process mode register PRI is set as such through the process shown in FIG. 7. Also, when tempo change coefficients (tempo-up and tempo-down coefficients) and tempo followability data (time intervals for tempo increase and decrease) have been set as desired by the user, they are stored into the tempo-up coefficient register UPC, tempo-down coefficient register DNC, tempo-up followability register EU and tempo-down followability register ED, respectively, through the processes shown in FIGS. 8 and 9. Of course, the contents set in the setting processes (those of FIGS. 7–9) can be changed even during the course of the automatic play.

Next, when the play switch has been turned on after the selection of a desired reproduction channel, the play switch event process shown in FIG. 10 is performed. In this process, step 26 is performed for the key-on event subroutine shown in FIG. 11, if the foremost play data is key-on data. In this key-on event subroutine, the key code and velocity data are stored into a predetermined key code register KCD and a velocity register VEL, respectively. Thus, a tone corresponding to the key-on data is sounded with a touch response controlled by the velocity data.

In the case where the play data next to the key-on data is time interval data, step 75 of the tempo clock interruption routine shown in FIG. 14 is performed, and then step 71 of the interruption routine is repeated in response to each tempo clock timing to decrement the time interval data for time counting. When the time counting corresponding to the time interval has been completed, the next play data is read out through step 70 shown in FIG. 14, and then similar operations are repeated.

When a tone is being generated with no change in the tempo clock frequency, steps 52–65 of the tempo change process shown in FIG. 13 are not implemented, but step 67 and following other steps in FIG. 14 are repeatedly implemented.

When the tempo setting event process is performed during the repetition of these operations, a new tempo clock frequency value is stored into the target tempo register TNEW, and respective values of the tempo-up and tempo-down followability registers EU, ED are stored into the tempo-up and tempo-down time measuring registers EXU, EXD. At this time, the tempo followability data EPRI in the program and data memory 11 is also stored into the time measuring register EXPRI. Then, step 52 and following other steps shown in FIG. 13 are performed, so that tempo setting data indicative of tempo changing gradually from the current value to the target value is sent out to the tempo clock generator 18, and thus the automatic play tempo is changed gradually and smoothly until it reaches the target value.

Although in the above described embodiment, the tempo change coefficient and the tempo followability can be respectively set as desired by the user, the invention is not restricted to this, and other variations are possible. For instance, as in the example of FIG. 4A, only the tempo followability may be set at different values for the tempo increase and decrease with the tempo increase any decrease amounts being made equal to each other, or, as in the example of FIG. 4B, only the tempo increase and decrease amounts may be set at different values with the tempo followability being made equal for the tempo increase and decrease. Any combination of such variations may be made as desired.

Figure 15:
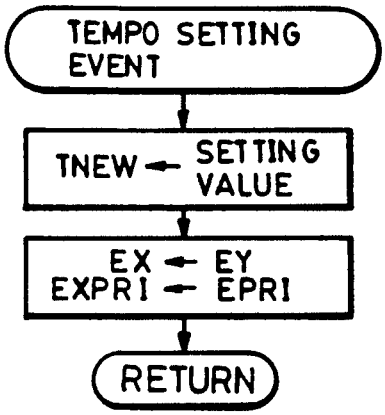
FIG. 15 is a flow chart showing a modification of the tempo setting event process shown in FIG. 6.
Figure 16:
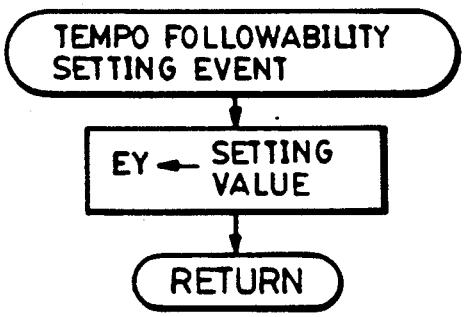
FIG. 16 is a flow chart showing a modification of the tempo followability setting event process shown in FIG. 9.

For example, in the case where only the tempo increase and decrease amounts are changeable with the tempo followability being equal for the tempo increase and decrease as in the example of FIG. 4B, the tempo-up and tempo-down followability registers EU, ED of FIG. 9 may be combined into a single tempo followability register EY as shown in FIG. 16, and the tempo-up and tempo-down time measuring registers EXU, EXD of FIG. 6 may be combined into a single time measuring register EX as shown in FIG. 15. In such case, the flow chart in FIG. 13 may be revised as shown in FIG. 17.

Figure 17:
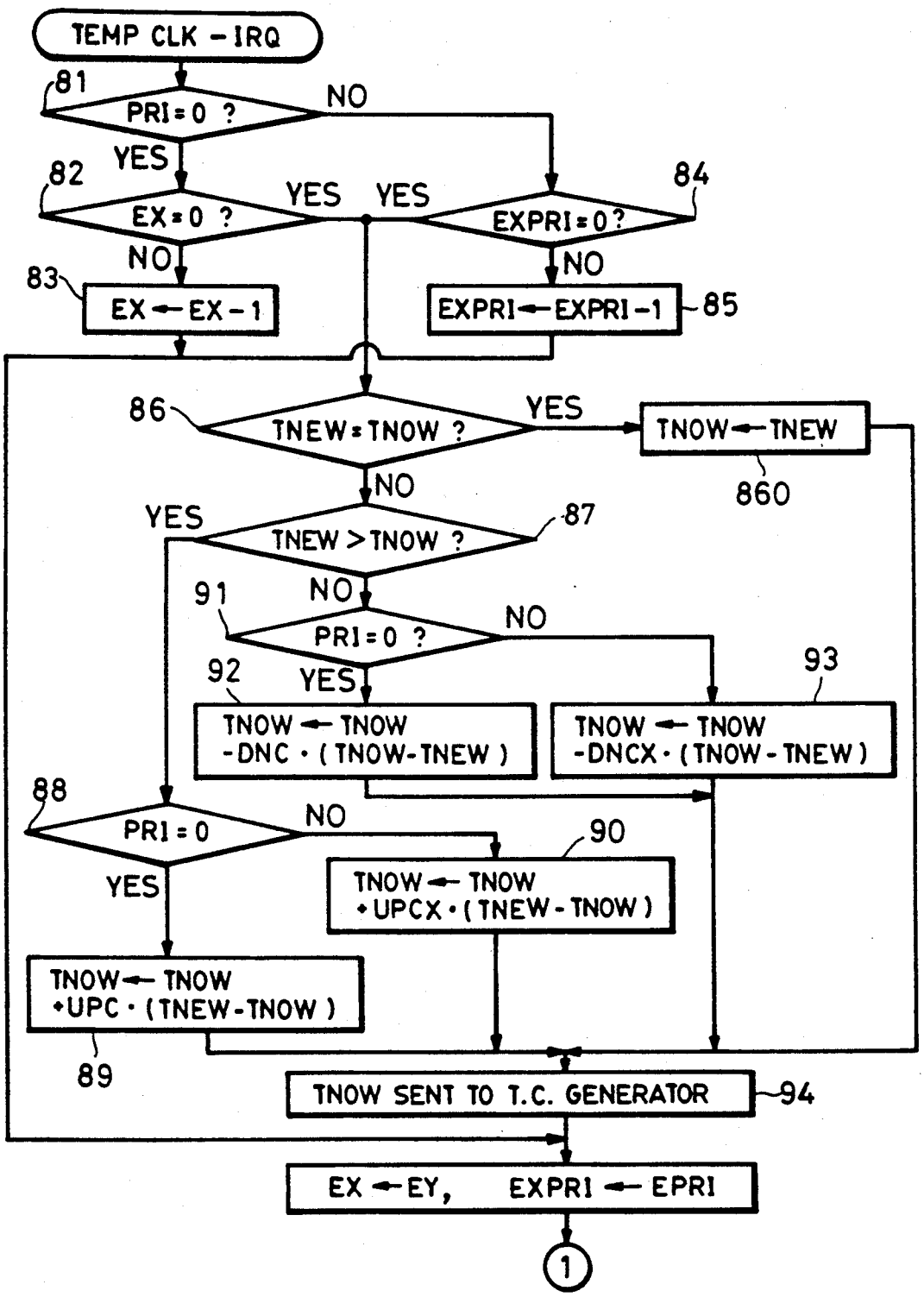
FIG. 17 is a flow chart showing a modification of the tempo clock interruption process shown in FIG. 13.

In FIG. 17, steps 53 and 60 in FIG. 13 are combined into step 81 where the determination of the process mode is first implemented. Depending on the determination result, next step 82 or 84 is implemented. These steps 82 and 84 correspond to steps 54, 57, 61 and 64 in FIG. 13. In each of steps 82, 84, it is determined whether or not the tempo-up process or the tempo-down process can be performed at that moment, that is, whether or not the value of the time measuring register EX or EXPRI is "0". If the value is not "0" (the determination result is NO), it is meant that the current operation time is in the midst of the time interval Eb of FIG. 4B, and thus the tempo clock frequency value at that time is maintained and the flow advances to step 83 or 84 for countdown of time. After such countdown, the flow jumps over to step 67.

On the other hand, if the value of the time measuring register EX or EXPRI is "0" (the determination result is YES), it is meant that the current operation time corresponds to one of the times T0-T6, T7-T12 or t0-t6, t7-t10, the flow advances to step 86 so that the tempo increase or decrease amount at that time is calculated. In steps 86, 87, operations similar to those of steps 51, 52 in FIG. 13 are implemented; namely, the values of the tempo setting register TNOW and the target tempo register TNEW are compared with each other, and branches to different steps are made depending on the comparison result. The tempo-up operations are implemented in steps 88–90, and the tempo-down operations are implemented in steps 91–93. In steps 88, 91, the examination on the process mode is performed as in step 81. In steps 89, 90, 92, 93, operations similar to those of steps 56, 59, 63, 65 in FIG. 13 are performed depending on the determination result. After that, the flow advances to step 94 in which the value of the tempo setting register TNOW is sent out to the tempo clock generator 18. The process shown in FIG. 17 is completed in this manner. As apparent from the foregoing, most of the operations in FIG. 17 are similar to those in FIG. 13.

The determination of "TNEW=TNOW" in step 51 of FIG. 13 and in step 86 of FIG. 17 need not be made on an exact coincidence between the two (TNEW and TNOW), and unappreciable difference therebetween may be tolerated. For this reason, in the case where the determination result in step 51 or 86 is YES, step 510 or 860 is implemented so as to realize exact coincidence between TNEW and TNOW; however, step 510 or 860 may be omitted.

Although in the above embodiment, single data is used as the tempo followability data EPRI for the preset mode, plural different data may be used as the followability data for the tempo-up and tempo-down operations.

Further, although in the embodiment, the tempo increase amounts for the tempo-up operation and the tempo decrease amounts for the tempo-down operation are made gradually smaller to follow a logarithmic interpolation curve, the tempo may be increased or decreased linearly, in which case calculation formulas of steps 59, 63, 65, 89, 90, 92, 93 may be replaced by other suitable ones.

Although, in the examples of FIGS. 4A and 4B, the time intervals (tempo followability) for the tempo-up or tempo-down operations have been shown as uniform, in practice, they may vary slightly due to the fluctuation of the tempo clock itself, because the processes of FIGS. 13, 14 and 17 are performed in response to tempo clock interruption. However, some suitable control may be considered. The unit time intervals (tempo followability) can be made precisely uniform, by performing each of the processes of FIGS. 13 and 17 as an interruption process based on fixed clock pulses and by performing only the process of FIG. 14 as a tempo clock interruption process.

Now, another embodiment of the invention will be described with reference to FIGS. 18–22, this embodiments showing a modification of the tempo setting or adjusting means.

Figure 18:
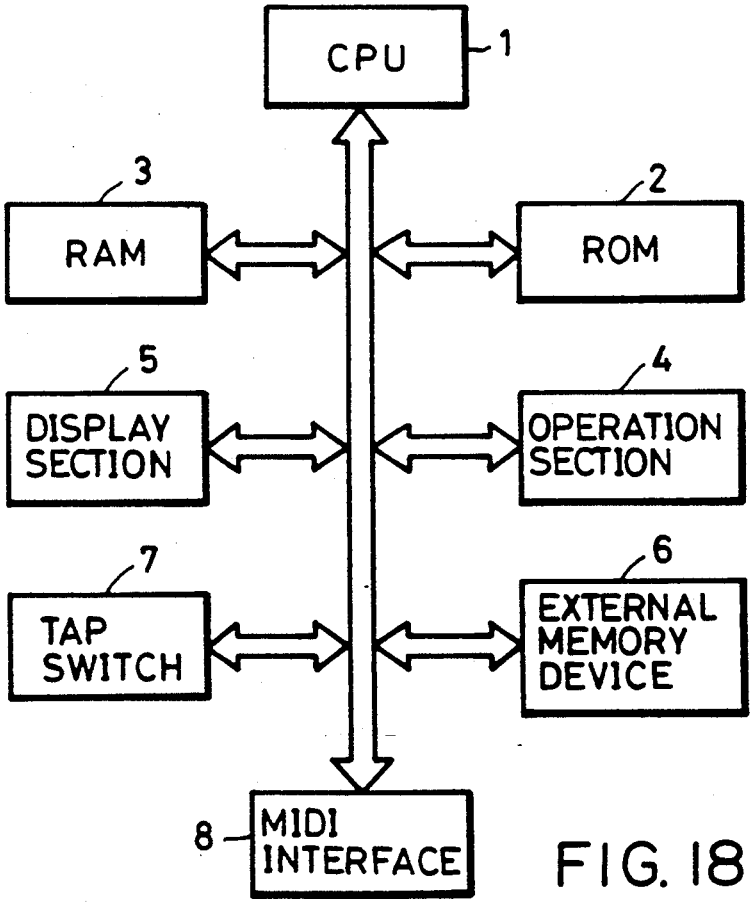
FIG. 18 is a block diagram showing a hardware construction of another embodiment according to the invention.
Figure 19:
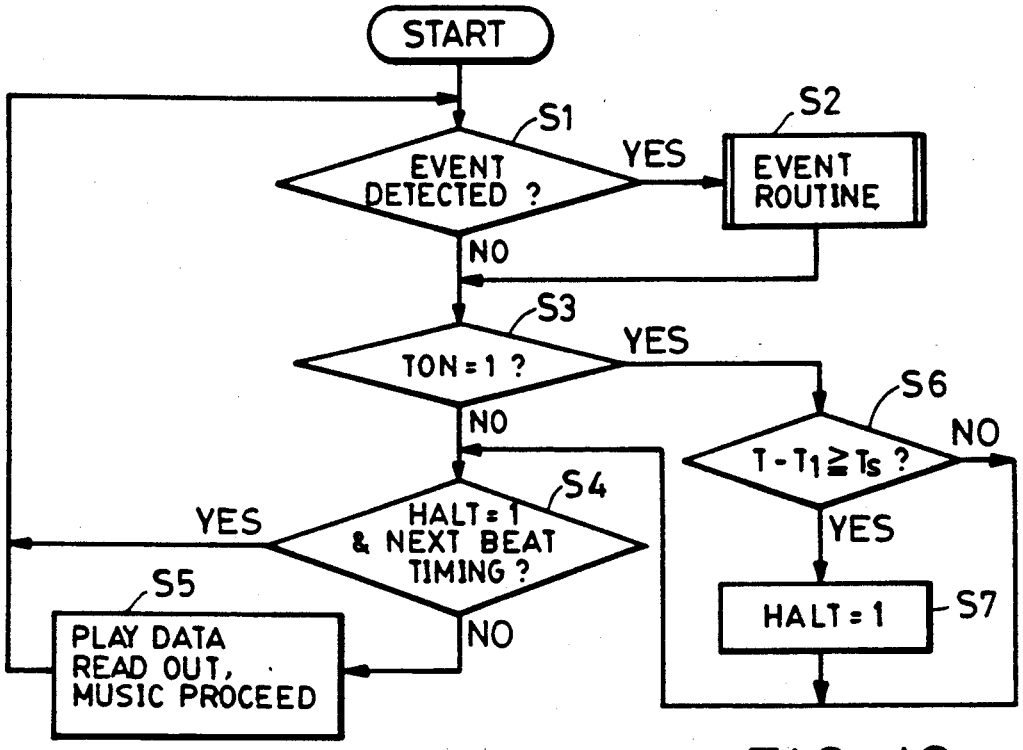
FIG. 19 is a flow chart showing an example of a main routine performed by a CPU shown in FIG. 18.

FIG. 18 shows another embodiment of the sequencer-type automatic play device. This automatic play device is connected via the MIDI interface to a MIDI musical instrument such as a musical synthesizer for automatically playing the instrument. The MIDI musical instrument itself may have a keyboard and a tone source, or the keyboard and the tone source may be separately provided from the musical instrument as in the above described embodiment. In this case, if more than 3-beat time have passed after the foot pedal was last stepped on, the determination results in YES and step SP7 is taken. In step SP7, the previously set tempo TMP is adopted as a current tempo. In this manner, if the tap-on interval ΔT exceeds 3-beat time, that portion is considered to be a break portion and the previously set tempo TMP is maintained in the play, and then return to the main routine of FIG. 19 is effected. This is for the purpose of using the break time in the tempo calculation, to avoid playing at an extremely slow tempo.

Upon release of the foot pedal, a tap-off event ocurrs and then step SP8 is taken, in which the tap-on flag TON is set at "0". After that, return to the main routine of FIG. 19 is effected. When return to step S3 is effected after such tap-on event, the determination in step S3 result in YES since the tap-on flag TON has been set at "1", and step 6 is taken. In step 6, time difference between the current time and the most recent tap-on event time T1, namely, time length for which the foot pedal has been stepped on is calculated, and whether or not the time length is greater than a predetermined automatic play stop detection value Ts. As this detection value Ts, time corresponding to 0.8 beat, for example, is set. When the foot pedal is released after having been stepped on for time length more than 0.8-beat time, the determination results in YES and step S7 is taken. In step S7, the automatic play stop flag HALT is set at "1".

Next in step S4, it is determined whether or not the value of the automatic play stop flag HALT is "1" and the play data is at the next beat timing. If the result is NO, the music continues to be read out until the result becomes "0", namely, the play data comes to the next beat timing. At the next beat timing, the determination results in YES, and then read-out of the music is caused to stop. When the foot pedal is stepped on again at the next beat, the result in the abovementioned step SP6 becomes NO because the tap-on interval ΔT at this time is within 3-beat time, and advance to step SP9 is effected. In step SP9, a new tempo TMP 2 is calculated in correspondence to the abovementioned tap-on interval ΔT. At this time, the tempo will be slower than before because the tap-on interval is more than one beat time.

Now, the manner in which the calculation is made will be described. First, for example, time corresponding to 70 percent of the tap-on interval ΔT is calculated, and a tempo TMP' of a beat number corresponding thereto is calculated. Then, the new tempo TMP 2 which is the mixture of the tempo TMP' and previous tempo TMP is calculated, the mixture of the two tempos TMP' and TMP being made in the ratio of 6: 4. The play tempo is subsequently changed in accordance with the new tempo TMP2, and read-out of the music is started again. By thus adopting only part of the new tempo, undesirable abrupt tempo change can be avoided.

Thereafter, the tempo is gradually adjusted to get slower by performing tap operation such that the tap-on intervals ΔT become gradually longer as shown in part (a) of FIG. 21. As mentioned, by performing tap operation such that the tap-on intervals ΔT become gradually longer under the condition that a step-on duration of the foot pedal is below 0.8-beat time and also a tap-on interval ΔT is below 3-beat time, the tempo is adjusted while the play stops at the next beat. The reason why the tempo is not controlled directly by the tap-on interval ΔT is that unnaturalness in tempo change can be avoided even if the tap-on intervals ΔT is changed abruptly. Also, with the functions as described, it becomes possible to realize tempo control well matched to the player's sensibility.

[2] Function when the automatic play is to be stopped:

If the player continues to step on the foot pedal for a time length beyond the automatic play stop detection value Ts (for example, time corresponding to 0.8 beat), the automatic play is caused to stop at the next beat of the play data upon lapse of the time corresponding to 0.8 beat (see part (a) of FIG. 22). By such tap operation, the play can be caused to stop at a natural timing corresponding to the music tempo.

[3] Function when the automatic play is to be started again:

When the foot pedal has been stepped on again (at T2 shown in part (a) of FIG. 22) after the play stopped, the automatic play stop flag HALT is reset through steps SP1–SP5 and advance to step SP6 is effected. In step SP6, whether or not the tap-on interval ΔT is equal to or greater than the break value Tb. If the tap-on interval is equal to or greater than 3-beat time, the play is started again at the previous tempo TMP which was the tempo when the play stopped.

Thereafter, as shown in part (a) of FIG. 22, the music is adjusted gradually to a faster tempo by such tap operation that makes the tap intervals ΔT gradually shorter.

Figure 20:
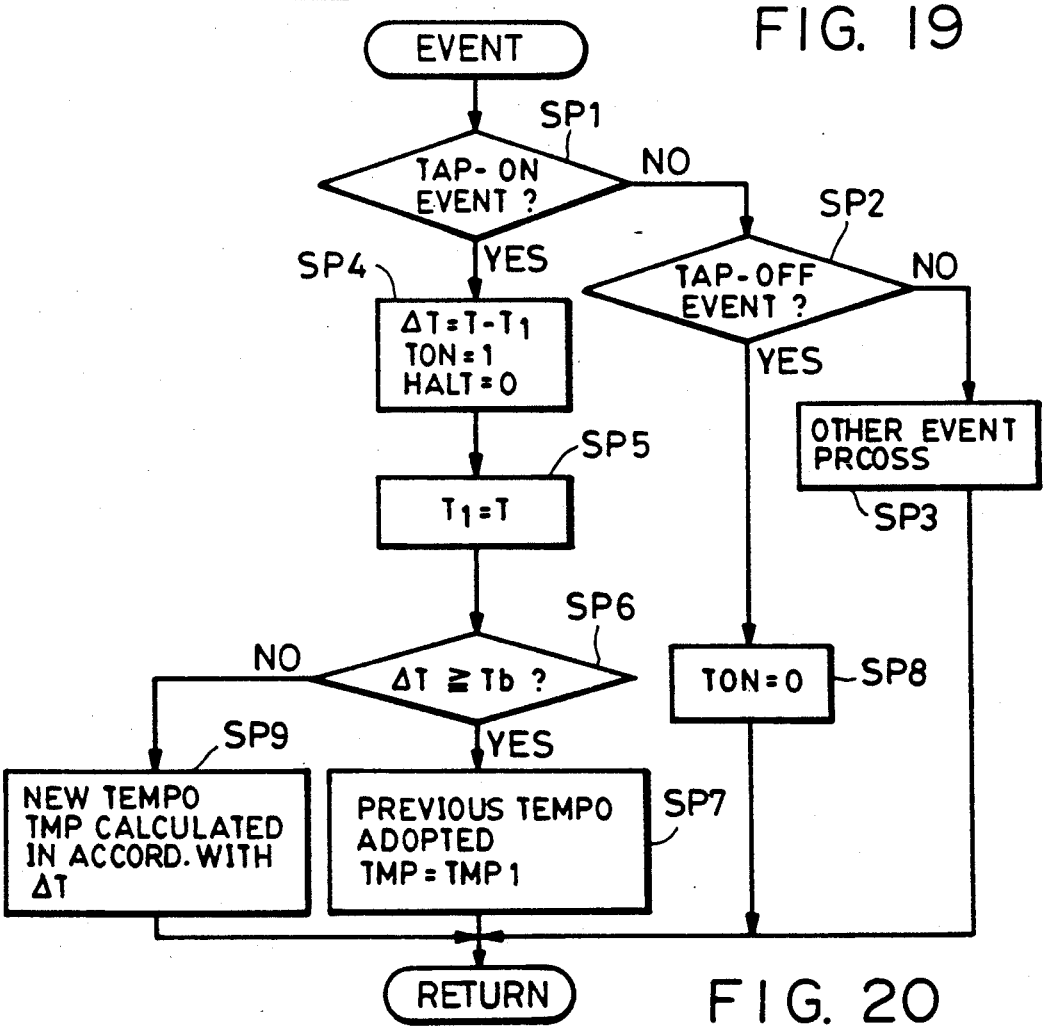
FIG. 20 is a flow chart showing an example of an event routine performed in FIG. 19.

In the described embodiment, the automatic play stop detection value Ts and the break value Tb may be set as desired in stead of being fixedly set. Further, The coefficients and mixture ratio for tempo calculation as mentioned in step SP9 of FIG. 20 are of course variable. In this manner, it becomes possible to deal with various kinds of music.

Although all the embodiments have been described as embodying the invention by software processes, dedicated hardware construction may be employed for performing various controls similar to those described. Of course, the automatic play device to which the present invention is applied is not restricted to a sequencer as described above, but it may be an automatic accompaniment device such as for automatic bass code, automatic arpeggio, or an automatic rhythm playing device, or any other types of automatic play devices that perform automatic play in accordance with tempo clock pulses.

According to the present invention as described so far, when a tempo setting value is changed, tempo signal frequency, namely, tempo clock frequency is caused to gradually change from one frequency corresponding to the unchanged, previous tempo setting value to another frequency corresponding to the newly changed tempo setting value. As the result, when tempo change operation is effected, the automatic play tempo does not change immediately to the intended new tempo, but it changes gradually from the previous tempo to the new tempo, so that smooth tempo change can be effectively realized. Therefore, an impression of awkward intermission due to abrupt tempo change can be avoided. Also, even when manual play and automatic play are simultaneously performed and it is desired to smoothly change the automatic play tempo in correspondence to the change in the manual play tempo, tempo change operation can be done easily.

Further, according to the invention, since measuring means measures a measurement time between the time when switch means turns to an on-state and the time when the switch means next turns to a next on-state, adjusting means changes play tempo in accordance with the measured time and maintains the play tempo until a new measurement time is measured, and detecting means detects when the on-state duration of the switch means exceeds a predetermined time, so that the adjusting means causes the play to be stopped at the next beat of the play data in accordance with the detection by the detecting means. As the result, it is permitted to adjust the play tempo by tap operation well matched to the player's sensibility.

What is claimed is:

1. An automatic play device which comprises:

tempo setting selection means for selecting a tempo setting value;

tempo signal generating means for generating a tempo signal at a frequency corresponding to a first tempo setting value;

automatic tone generating means for automatically generating a tone in accordance with a tempo determined by said tempo signal; and tempo change controlling means, responsive to a change of the tempo setting value to a second tempo setting value by said tempo setting selection means, for changing the frequency of the tempo signal at a predetermined rate from a first frequency corresponding to the first tempo setting value to a second frequency corresponding to the second tempo setting value, the frequency of the tempo signal being changed by a given amount at a given time interval, and at least one of (1) the amount of change of the frequency of the tempo signal and (2) the given time interval being differentiated between a time when the tempo is made faster and a time when the tempo is made slower.

2. An automatic play device as defined in claim 1, wherein said tempo change controlling means changes the frequency of the tempo signal at a predetermined rate such that changes in the frequency of the tempo signal become gradually smaller as the frequency of the tempo signal approaches the second frequency corresponding to the second tempo setting value.

3. An automatic play device as defined in claim 1, wherein said tempo change controlling means changes the frequency of the tempo signal from the first frequency to the second frequency over a plurality of predetermined time intervals, and wherein an amount of change of the frequency of the tempo signal in respective time intervals becomes gradually smaller as the frequency of the tempo signal approaches the second frequency corresponding to the second tempo setting value.

4. An automatic play device as defined in claim 3, wherein said tempo change controlling means includes change coefficient means for setting a change coefficient for variably adjusting an amount of change of the frequency of the in each of the plurality of time intervals, said change coefficient being different depending on whether the tempo is made faster or slower.

5. An automatic play device as defined in claim 3, wherein a length of each of the plurality of time intervals is selected based on the selected setting value.

6. An automatic play device as defined in claim 4, wherein said tempo change controlling means further includes followability setting means for independently setting a length of each of the plurality of time intervals based on the selected tempo setting value, and wherein said change coefficient means sets a change coefficient for variably adjusting the amount of change of the frequency in each of the plurality of intervals independently based on whether the tempo setting value.

7. An automatic play device as defined in claim 1, wherein said tempo change controlling means controls the predetermined rate of change of the frequency of the tempo signal based on the tempo setting value.

8. An automatic play device as defined in claim 7, wherein said tempo change controlling means controls the predetermined rate of change such that the change rate is greater when the tempo is made faster than the rate of change when the tempo is made slower.

9. An automatic play device as defined in claim 1, wherein said tempo change controlling means includes change rate setting means for variably setting the predetermined rate of change of the frequency.

10. An automatic play device comprising:

memory means for storing play data, reading means for reading out the stored play data in a predetermined performance sequence, automatic tone generation means, responsive to the reading means, for automatically generating tones based on the stored play data, switch means for controlling beat timing, monitoring means for monitoring ON-operation and OFF-operation of the switch means, tempo controlling means for controlling a reading tempo of said reading means on the basis of a time interval between ON-operations of said switch means, and stop controlling means for stopping the automatic generation of tones when a duration of time from ON-operation to OFF-operation of the switch means exceeds a predetermined time.

11. An automatic play device according to claim 10, wherein said stop controlling means stops the automatic generation of tones at a next beat of the play data when said duration of time exceeds a predetermined time.

12. An automatic play device according to claim 10, wherein said automatic tone generation means restarts, in response to ON-operation of the switch means the automatic generation of tones after the generation of tones is stopped by the stop controlling means.

13. An automatic play device according to claim 12, wherein the tempo controlling means determines a tempo for the automatic generation of tones at the time of restarting, in accordance with a tempo at the time when the automatic generation of tones is stopped.

14. An automatic play device according to claim 10, wherein said tempo controlling means maintains a same tempo until a new ON-operation of the switch means is monitored.

15. An automatic play device which comprises:

tempo setting selection means for selecting a tempo setting value;

tempo signal generating means for generating a tempo signal at a frequency corresponding to a first tempo setting value;

automatic tone generating means for automatically generating a tone in accordance with a tempo determined by said tempo signal; and tempo change controlling means, responsive to a change of the tempo setting value to a second tempo setting value by said tempo setting selection means, for changing the frequency of the tempo signal at a predetermined rate from a first frequency corresponding to the first tempo setting value to a second frequency corresponding to the second tempo setting value, the tempo change controlling means changing the frequency of the tempo signal from the first frequency to the second frequency over a plurality of predetermined time intervals, wherein an amount of change of the frequency of the tempo signal in respective time intervals becomes gradually smaller as the frequency of the tempo signal approaches the second frequency corresponding to the second tempo setting value, and wherein said tempo change controlling means includes change coefficient means for setting a change coefficient for variably adjusting an amount of change of the frequency in each of the plurality of time intervals, said change coefficient being different depending on whether the tempo is made faster or slower.

16. An automatic play device which comprises:

tempo setting selection means for selecting a tempo setting value;

tempo signal generating means for generating a tempo signal at a frequency corresponding to a first tempo setting value;

automatic tone generating means for automatically generating a tone in accordance with a tempo determined by said tempo signal; and tempo change controlling means, responsive to a change of the tempo setting value to a second tempo setting value by said tempo setting selection means, for changing the frequency of the tempo signal at a predetermined rate from a first frequency corresponding to the first tempo setting value to a second frequency corresponding to the second tempo setting value, the tempo change controlling means changing the frequency of the tempo signal from the first frequency to the second frequency over a plurality of predetermined time intervals, wherein an amount of change of the frequency of the tempo signal in respective time intervals becomes gradually smaller as the frequency of the tempo signal approaches the second frequency corresponding to the second tempo setting value, and wherein a length of each of the plurality of time intervals is selected based on the selected setting value.

17. An automatic play device as defined in claim 15, wherein said tempo change controlling means further includes followability setting means for independently setting a length of each of the plurality of time intervals based on the selected tempo setting value, and wherein said change coefficient means sets a change coefficient for variably adjusting the amount of change of the frequency in each of the plurality of intervals independently based on the tempo setting value.

* * * * *